United States Patent [19]

Lambert

[11] Patent Number: 4,885,849

[45] Date of Patent: Dec. 12, 1989

[54] INSOLE

[75] Inventor: Blair W. Lambert, Albemarle, N.C.

[73] Assignee: Space Age Enterprises, Inc., Albermarle, N.C.

[21] Appl. No.: 211,813

[22] Filed: Jun. 24, 1988

[51] Int. Cl.[4] ..... A43B 7/06; A43B 13/38; A43B 13/40

[52] U.S. Cl. ..... 36/3 B; 36/44; 128/588

[58] Field of Search ..... 36/43, 44, 3 R, 3 B; 128/588

[56] References Cited

U.S. PATENT DOCUMENTS 2,560,120 7/1951 Miller et al. ..... 128/588 X
3,142,912 8/1964 Larsen ..... 36/3 R

FOREIGN PATENT DOCUMENTS 532936 9/1931 Fed. Rep. of Germany ..... 36/3 B
320287 8/1934 Italy ..... 36/3 B
59-33363 8/1984 Japan ..... 36/3 B

*Primary Examiner*—James Kee Chi
*Attorney, Agent, or Firm*—A. Michael Tucker; Lynn E. Barber

[57] ABSTRACT

An insole includes a top wall and a bottom wall constructed from an air-impervious material. The top and bottom walls are heat-sealed at a durable side wall ridge to form an envelope having a heel, intermediate and front zones. A porous pad is contained within the envelope. Vent openings are provided only at the intermediate and front zones for ingress and egress of air from the envelope as the wearer walks on the insole. The total area of the vent openings in the front zone is greater than the total area of vent openings in the intermediate zone, thereby facilitating movement of air throughout the insole without imparting excessive pressure at the side wall ridge.

4 Claims, 1 Drawing Sheet

INSOLE

BACKGROUND OF THE INVENTION

1. Field of the Invention

The present invention relates to an insole worn between the foot and the shoe of a wearer to provide a comfortable and air-cushioning effect.

2. Description of the Related Art

Insoles or shoe inserts for increasing the comfort of the feet of the wearer have been previously known. Generally, various types of foam and compressionable materials have been utilized with insoles. With many insoles, air is forced from a cushioning material as a wearer walks to provide comfort to a wearer.

U.S. Pat. No. 4,336,661 discloses a shoe insert having an air-impervious envelope and a pad contained therein. The envelope includes a plurality of vent openings throughout its length which release air from the envelope as a wearer walks on the insert.

U.S. Pat. No. 4,571,853 discloses a shoe insert having a plurality of vent openings throughout its length for releasing air as a wearer walks on the insert, wherein the diameter of the vent openings at the heel and toe portions are smaller than the diameter of the vent opening at the arch portion.

U.S. Pat. No. 4,590,689 discloses an insole having vent openings at the heel and toe portions. A foam heelpiece cooperates with the vent openings to meter the escape of air from the insole.

A particular problem of prior art insoles is their tendency to split at the side walls. As a wearer shifts his or her weight on an insole, air is simultaneously moved inside of, released from and drawn into an envelope. Air can become trapped and forced against a side wall until the pressure exceeds the strength of the side wall, causing the side wall to split apart.

The art continues to seek improvements. It is desirable that an insole provide a cushioning and comfortable effect as a wearer walks on it. Furthermore, it is desirable that an insole be durable and long-lasting, and avoid the common problem of splitting at the side walls as found in prior art insoles.

SUMMARY OF THE INVENTION

The present invention includes an insole to be placed between the wearer's foot and a shoe. The insole provides a system of vent openings in an envelope that permit the escape of air and provide a cushioning effect. The present insole includes a side wall construction that avoids splitting and provides a long-lasting construction.

The present invention includes an insole having a top wall and a bottom wall constructed from an air-impervious material. The top and bottom walls are heat-sealed at a durable side wall ridge to form an envelope having heel, intermediate and front zones. A porous pad is contained within the envelope. Vent openings are provided only at the intermediate and front zones for ingress and egress of air from the envelope as the wearer walks on the insole. The total area of the vent openings in the front zone is greater than the total area of vent openings in the intermediate zone, thereby facilitating movement of air throughout the insole without imparting excessive pressure at the side wall ridge and adhesive strips on the outer surface of the bottom wall to secure the insole within a shoe.

DETAIL DESCRIPTION OF THE PREFERRED EMBODIMENT

Figure 1:
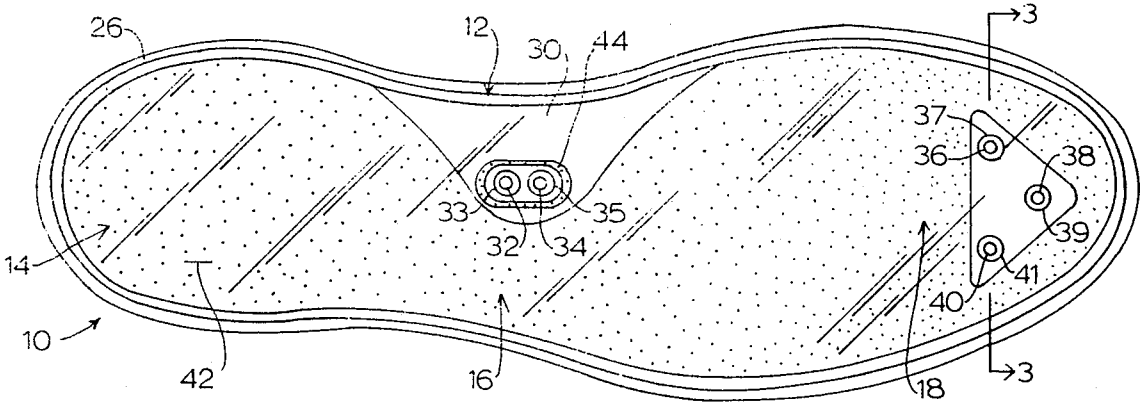
FIG. 1 is a top plan view of the insole of the present invention.
Figure 2:
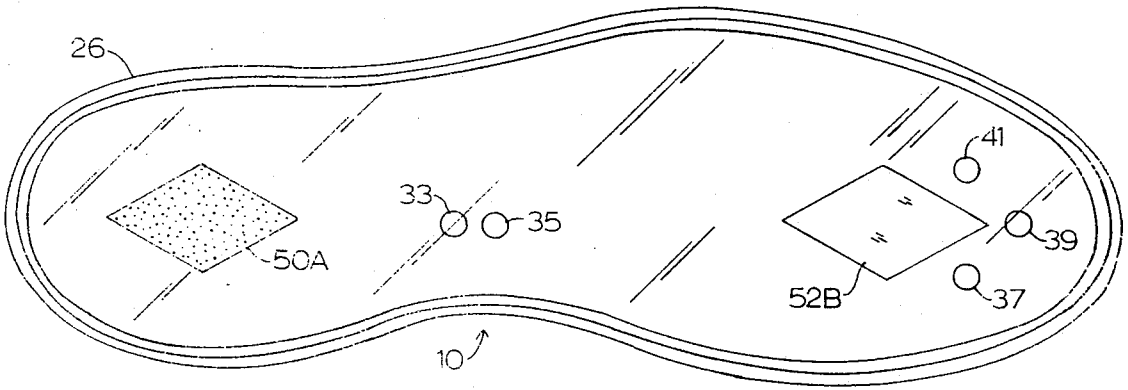
FIG. 2 is a bottom plan view of the insole of FIG. 1.
Figure 3:
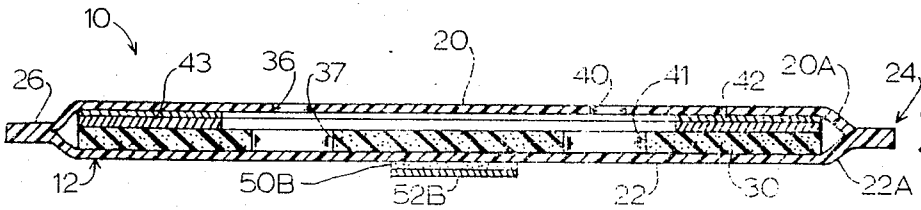
FIG. 3 is a greatly enlarged sectional view taken along line 1—1 of FIG. 1 wherein the thickness of a printed pattern is exaggerated for purposes of clarity of illustration.

The present insole, indicated generally at 10, is illustrated in FIGS. 1–3. The insole includes an envelope 12 constructed from a material which is impervious to air, such as a sheet of flexible, pliable material. For convenience, the envelope 12 may be considered as having a heel zone 14 for supporting the heel portion of the foot, an intermediate zone 16 for supporting the arch and mid-portion of the foot, and a forward zone 18 for supporting the toes and front portion of the foot.

The envelope 12 generally traces the outline of the human foot and includes a top surface or wall 20, a bottom surface or wall 22 and a side wall 24. Side wall 24 is formed by heat-sealing the peripheries of top wall 20 and bottom wall 22 together to form a ridge 26 around the envelope 12. In a preferred method of fabrication, top wall 20 slopes downward and outward as indicated at 20A and bottom wall 22 slopes upward and outward as indicated at 22A in FIG. 3. Preferably upper and lower walls 20 and 22 are constructed of transparent polyethylene plastic sheet material, such as vinyl.

Within envelope 12, a pad 30 of porous, cushioning material is provided. Pad 30 is sized to nestle between the top wall 20 and bottom wall 22 and generally spans the interior of the envelope 12. Preferably, pad 30 is a resident foam member. If desired, pad 30 can be impregnated with very fine charcoal for enhanced humidity absorption.

A plurality of vent openings is provided in the top wall 20. In the embodiment of the insole 10 illustrated in FIGS. 1–3, two vent openings 32 and 34 are provided in the top wall 20 at the intermediate zone 6. Directly beneath each opening 32 and 34, holes 33 and 35 are provided in pad 30. The diameter of each hole 33 and 35 is slightly greater than the diameter of each opening 32 and 34 and facilitates the passage of air through pad 30 and envelope 12.

Three vent openings 36, 38 and 40 are provided in the top wall 20 at the front zone 18. In the embodiment of the insole 10 illustrated in FIGS. 1–3, vent openings 36, 38 and 40 are arranged in a triangular pattern and are strategically located beneath the toes and forward of the ball portion of the foot. Directly beneath each opening 36, 38 and 40, holes 37, 39 and 41 are provided in pad 30. The diameter of holes 37, 39 and 41 is slightly greater than the diameter of respective openings 36, 38 and 40.

The diameter of vent openings 32, 34, 36, 38 and 40 is of sufficient area to permit the passage of air to and from envelope 12. Each opening 32, 34, 36, 38 and 40 of insole 10 has a diameter of substantially the same size. With two vent openings 32 and 34 in the intermediate zone 16 and three vent openings 36, 38 and 40 in the front zone 18, the total area of vent openings in the front zone 18 is greater than the total area of vent openings in the intermediate zone 16.

In use when insole 10 is inserted in a shoe, the wearer places his or her heel down on heel portion 14 when walking which forces air through pad 30 and into the intermediate zone 16 and the front zone 18. Because the total area of vent openings 36, 38 and 40 in the front zone 26 is greater than the total area of vent openings 32 and 34 in the intermediate zone 24, more air is released from the front zone 18 than the intermediate zone 16. During the time a wearer's heel forces down on the heel portion 22, the ball portion of the wearer's foot does not cover vent openings 36, 38 and 40, thereby facilitating ingress and egress of air from the envelope 12. As the wearer's weight shifts to the ball portion of the foot, air continues to travel through openings 36, 38 and 40 and vent openings 32 and 34. Such release of air from the envelope 12 provides an improved cushioning effect and prevents side walls 18 from splitting, thereby increasing the life of the insole 10.

It will be noted that no vent openings are provided in the heel zone 14. The lack of any openings in the heel zone 14 facilitates the movement of air in envelope 12 as described above and enhances the comforting effect that insole 10 provides to a wearer.

If preferred, a thin layer 43 of rubbery-type material can be provided between pad 30 and the inner surface of top wall 20. Layer 43 can be adhesively secured to the inner surface of top wall 20. Preferably, layer 43 has holes therein which vertically register with the aforementioned holes in pad 30.

For aesthetic purposes, a printed pattern, indicated generally at 42 and illustrated as a speckled pattern in FIG. 1 can be provided on the inner surface of top wall 20 adjacent layer 40. Preferably, printed pattern 42 is an opaque aluminum paint which is selectively silk screen printed to the inner surface of top wall 20. Printed pattern 42 includes a non-painted pattern about vent openings 36, 38 and 40, respectively. A printed pattern 44 in the shape of an oval can be provided about vent opening 32 and 34.

To retain insole 10 in a shoe, adhesive strips 50A and 50B are provided on the outer surface of bottom wall 22 adjacent a shoe. Prior to insertion, removable covers 52A (not illustrated) and 52B can be retained on adhesive strips 50A and 50B until insole 10 is ready for use.

Although the present invention has been described with reference to a preferred embodiment, workers skilled in the art will recognize that changes may be made in form and detail without departing from the spirit and scope of the invention.

What is claimed is:

1. An insole to be placed between a wearer's foot and a shoe, comprising:

(a) a top wall and a bottom wall, each constructed from an air-impervious flexible material, heat-sealed at their peripheries in a side wall ridge to form an envelope, the envelope as seen in plan, tracing the outline of a human foot and having a heel zone, intermediate zone, and a front zone;

(b) a plurality of vent openings in the intermediate and front zones only of the top wall constructed and arranged so that the total area of the vent openings in the front zone is greater than the total area of the vent openings in the intermediate zone;

(c) a pad of cushioning material contained inside the envelope and spanning the interior of the envelope; and (d) a plurality of holes in the pad in registry with the vent openings of the upper surface of the envelope, wherein the diameter of each hole is slightly greater than the diameter of each respective vent opening; whereby as the wearer of the insole walks and asserts pressure on the heel zone, a greater amount of air is forced from the envelope through the vent openings in the front zone than is forced through the vent openings in the intermediate zone, said insole having no holes or vent openings in the heel zone.

2. The insole as specified in claim 1 wherein:

(a) two vent openings are provided in the intermediate zone; and (b) three vent openings are provided in the front zone.

3. An insole according to claim 1, wherein the vent openings in the front zone are arranged in a triangular shape.

4. An insole according to claim 1, further comprising a thin layer of flexible material between the pad and inner surface of the top wall, said thin layer having holes vertically registered with the vent openings.

* * * * *